US008106615B2

(12) United States Patent
Tsuruta et al.

(10) Patent No.: US 8,106,615 B2
(45) Date of Patent: Jan. 31, 2012

(54) PUMP JACK PUMP-OFF CONTROL METHOD AND PUMP JACK CONTROL APPARATUS

(75) Inventors: Tatsumi Tsuruta, Fukuoka (JP); Yoichi Yamamoto, Fukuoka (JP); Koji Kawamoto, Fukuoka (JP); Tetsuo Kawano, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 305 days.

(21) Appl. No.: 12/446,852

(22) PCT Filed: Oct. 4, 2007

(86) PCT No.: PCT/JP2007/069450

§ 371 (c)(1),
(2), (4) Date: May 18, 2009

(87) PCT Pub. No.: WO2008/050595

PCT Pub. Date: May 2, 2008

(65) Prior Publication Data

US 2010/0014989 A1 Jan. 21, 2010

(30) Foreign Application Priority Data

Oct. 24, 2006 (JP) ..... P.2006-288504

(51) Int. Cl.

| | |
|---|---|
| ***H02H 7/08*** | (2006.01) |
| ***H02P 23/00*** | (2006.01) |
| ***H02P 7/00*** | (2006.01) |
| ***F04B 49/06*** | (2006.01) |

(52) U.S. Cl. ..... 318/471; 417/44.11

(58) Field of Classification Search ..... 318/471; 417/42, 44.11, 45, 53

See application file for complete search history.

(56) References Cited

U.S. PATENT DOCUMENTS

| | | | | |
|---|---|---|---|---|
| 5,441,389 | A * | 8/1995 | Wolcott et al. | 417/42 |
| 6,414,455 | B1 | 7/2002 | Watson | |
| 6,599,095 | B1 * | 7/2003 | Takada et al. | 417/53 |
| 2006/0149476 | A1 | 7/2006 | Gibbs et al. | |

FOREIGN PATENT DOCUMENTS

| | | | |
|---|---|---|---|
| JP | 02-045692 | A | 2/1990 |
| JP | 11-132155 | A | 5/1999 |
| WO | 00/66892 | A1 | 11/2000 |

* cited by examiner

*Primary Examiner* — Thomas Dougherty
(74) *Attorney, Agent, or Firm* — Sughrue Mion, PLLC

(57) ABSTRACT

It is an object of the invention to provide a pump jack pump-off control method and a pump jack control apparatus in which, even when the speed of a pump jack is reduced due to generation of a pump-off condition, the pump jack is not caused to stop due to the motor overload abnormality or the coagulated crude oil and, even when the pump-off condition is generated, the reduction of the production capacity of the pump jack can be prevented as much as possible. On detecting the pump-off condition, while the pump jack is in operation with the speed thereof being reduced, or while the pump jack is in operation at the lowest speed, according to the overload warning signal of an ac electric motor, the pump jack is switched over to its intermittent operation. Also, the pump jack can be operated in such a manner that the stroke speed of the pump jack in the up stroke operation can be switched from a sinusoidal wave form over to a rectangular wave form, or, in the operation of the pump jack by an inverter, the pump jack can be operated such that it can carry out its up stroke operation with a limit imposed on torque.

8 Claims, 8 Drawing Sheets

PUMP JACK PUMP-OFF CONTROL METHOD AND PUMP JACK CONTROL APPARATUS

TECHNICAL FIELD

The present invention relates to a pump-off control method for controlling a beam pump to be driven by a pump jack and a pump jack control apparatus.

RELATED ART

As regards sensors which are used to control the pump-off of a beam pump for use in oil wells, they have been developed from downhole fluid level or pressure indicators, flow and no-flow sensors, vibration sensors, and motor current sensors to modern dynagraph card method sensors which have been recently invented and are capable of analyzing and recording the loads of rods.

However, since a method using the above-mentioned conventional sensors raises a problem that it cannot secure desired accuracy, it is hardly put into actual practice. On the other hand, the dynagraph card methods can secure desired accuracy, but they need sensors for detecting the loads of sucking rods and devices for processing signals detected by such sensors, with the result that they are complicated and expensive.

Also, as a method for controlling the pump-off without using various sensors, there is proposed a method in which the pump-off of a pump jack is detected and, on detecting the pump-off, the speed of the pump jack is lowered until the pump-off disappears (for example, see the patent reference 1).

In FIG. 6, reference numeral 1 designates an induction motor for driving a pump jack, 2 a speed detector coupled directly to the induction motor 1 for detecting the speed of the induction motor 1, 3 a vector control inverter having a current minor loop, and 4*a* a pump-off control apparatus, respectively.

The vector control inverter 3 includes a straight line instruction device 31, a speed regulator 32, a current regulator 33, a PWM controller 34, a current transformer 35, and a vector calculator 36. The straight line instruction device 31 limits a speed reference Np, which is the output of the pump-off control apparatus 4*a*, to an acceleration rate set therein to thereby convert the speed reference Np to the speed reference Ns of the induction motor 1. The speed reference Ns is compared with an actual speed Ni detected by the speed detector 2, and the difference between them is amplified by the speed regulator 32 and is then output as a secondary current instruction I2*q* from the speed regulator 32.

A motor current is detected by the current transformer 35, while only the secondary current component of the motor current is detected as I2 by the vector calculator 36 and is compared with the secondary current instruction I2*q*. And, the difference between them is amplified by the current regulator 33, the pulse width of a voltage is adjusted by the PWM controller 34, and a secondary current necessary for driving a load is supplied to the induction motor 1. In this manner, the vector control inverter 3 automatically adjusts the motor speed such that the actual speed Ni can be equal to the speed reference Np.

The pump-off control by the pump-off control apparatus 4*a* is carried out according to, for example, a block diagram shown in FIG. 7. In FIG. 7, the pump-off control apparatus 4*a* includes a calculator 41, a secondary current reference generator 42, a comparator 43, an output relay 44, a sequencer 45*a*, a speed instruction function generator 46, a pump jack main speed setting device 47, a speed instruction switching device 48, and a speed instructing device 49. The calculator 41 has a function to calculate and store the average value (or effective value) of the instantaneous values of the secondary current relative to the time of each down stroke operation of the pump jack, and the calculator 41 detects I2AV (or I2RMS) in correspondence to the actual speed Ni of the induction motor 1. And, the secondary current reference generator 42 sets the average value reference I2AV* (or effective value reference I2RMS*) of the secondary current in the normal operation of the pump jack where no pump-off exists, and adjusts the thus set value I2AV* (or effective value reference I2RMS*) in correspondence to the actual speed Ni of the pump jack.

The average value I2AV (or effective value I2RMS) of the instantaneous values of the secondary current actually detected is compared with the set value I2AV* (or I2RMS*) in the comparator 43. If I2AV>I2AV* (or, I2RMS>I2RMS*), the generation of the pump-off is detected. On the other hand, if I2AV≦I2AV* (or, I2RMS≦I2RMS*), the removal of the pump-off is detected.

The sequencer 45*a* has a function to generally control the pump-off sequence and a function which, in correspondence to the generation and removal of the pump-off, issues a speed instruction for reducing and increasing the speed of the pump jack. Also, the sequencer 45*a* automatically determines the notch of the speed of the pump jack during the operation of the pump jack and also controls the speed instruction function generator 46 in such a manner that the pump jack speed can be a notch lower or higher than the current speed.

The main speed setting device 47 sets the highest speed that corresponds to the then-time state of the oil well, for example, Nps=100% speed, or Nps=80% speed.

Therefore, when the pump-off is detected while the pump jack is in operation at the thus set speed, the speed instruction function generator 46 is controlled to forcibly lower the speed of the pump jack by an amount corresponding to 1 notch. In other words, for the pump jack speed, ΔNpn is set for ΔNp1, and Np is set for Nps−ΔNp1. In this state, the pump-off control apparatus 4*a* waits for the removal of the pump-off condition. When the pump-off condition is detected continuously, the pump jack speed is lowered by another notch, for example, by setting ΔNp2 as 2×ΔNP1.

However, when Nps−Npn≦0, the pump jack is caused to stop. In this case, the speed instruction switching device 48 is switched to the side of the speed instructing device 49.

The speed instructing device 49 is used to generate a minute speed instruction for checking whether the pump-off condition is present or not. When this switching operation is completed, the pump jack, which is stopped because of the pump-off, is forcibly started again after the passage of a given time, is operated at a minute speed, and, during the minute speed operation of the pump jack, it is checked whether the pump-off condition is present or not.

When the pump-off removal is detected during the minute speed operation, the speed instruction switching device 48 is changed over to the side of the main speed setting Nps. In this manner, the pump jack is controlled again at the speed of Nps−ΔNpn=Np; and, while confirming the removal of the pump-off conditions sequentially, the speed of the pump jack is increased automatically and is thereby returned to the initially set speed Nps.

As described above, the pump-off control apparatus 4*a* calculates and stores the average value (or, effective value) of the instantaneous values of the secondary current of the induction motor 1, and compares it with the reference value to thereby detect the generation of the pump-off or the removal of the pump-off.

While checking the time lag of a discharge valve in the discharge operation according to the rising time of the secondary current, the detection of the generation or removal of the pump-off is carried out according to the block diagram of the pump-off control by a second pump-off control apparatus 4*b* shown in FIG. 8.

In FIG. 8, an IPCAL block 51 calculates and detects the maximum value I2P of the secondary instantaneous values with respect to the time of each down-stroke operation of the pump jack; and, when the secondary current reaches the I2P, the IPCAL 51 applies a logical signal "1" to an AND logical element 62.

A SIGMA block 61, while a pump-off detect relay DET 71 is on, adds up the time pulses Δt that are generated by a constant timing pulse generator 60. And, while the AND logical element 62 is "1", the added-up results of the SIGMA block 61 are written into a memory element 64 every second current sampling time. In other words, when the logical signal "1" is applied to the AND logical element 62 according to the I2P detected by the IPCAL block 51, the Δt time added up to the then time, namely, the value of ΣΔt is stored into the memory element 64. When the thus detected ΣΔt in the down stroke operation is expressed as Tp1 (sec), this value is divided by the output Tctr (sec) of a reference cycle time calculator (CTCAL) 66 to thereby provide tP1 (p.u.).

A memory element 52 is used to store a set reference time tPR (p.u.) which is compared with this tP1. In this case, Tpr can be set according to two methods. Specifically, Tpr can be manually set through an AND logical element 69, or can be set automatically through an AND logical element 63 as a value tPR which is obtained by dividing a value applied to a memory element 65 by Tctr. That is, the actual secondary current maximum value time tP1 (p.u.) is compared with the set reference time tPR (p.u.) set according to any one of the above methods, the difference between them is input to a comparator 43, and the comparator 43 switches an output relay 44 in the following manner.

When tP1>tPR (when a pump-off is generated), the output relay 44 is switched to the "DN" side and, oppositely, when tP1≦tPR (when a pump-off is removed), the output relay 44 is switched to the "UP" side.

The operations of a sequencer 45*b* and a speed instruction function generator 46 are similar to those shown in FIG. 7 and thus the description thereof is omitted here.

Here, a reference cycle time calculator (CTCAL) 66 takes in a pump jack speed in the form of Ni, calculates the ½ stroke time (=TS/2) according to this pump jack speed and a reduction ratio set as a mechanical constant, and outputs the calculated value as the reference cycle time Tctr. Also, the reference secondary current maximum value time when the pump jack is in normal operation is stored in the memory element 52 as the set reference time.

In this manner, the pump jack is controlled again at the speed of Nps−ΔNpn=Np, while confirming the removal of the pump-off conditions sequentially, and the speed of the pump jack is increased automatically and is thereby is restored to the highest speed that corresponds to the state of the initial speed oil well.

As described above, according to the procedure of the conventional pump jack using an induction motor the speed of which can be adjusted, using the average value (or effective value) of the secondary current in the suction operation, or using the time delay of the discharge valve in the discharge operation detected by checking the rising time of the secondary current, the generation or removal of the pump-off is detected and the speed of the pump jack is lowered down to a state where the pump-off does not exist any longer.

Patent Reference 1: International Publication No. 00/66892 Pamphlet

DISCLOSURE OF THE INVENTION

Problems to be Solved by the Invention

In the conventional pump-off control method, since there is taken the procedure in which, when the generation of the pump-off due to the floating gas of the oil well or the like is detected, the number of rotations of the motor is lowered, in a pump jack to be applied to crude oil which contains a large amount of paraffin, is high in viscosity, is mixed with sand and is easy to coagulate, there is raised a problem that, even when the speed of the pump jack is reduced, the pump jack is difficult to remove from the pump-off state. Also, since the load applied to the pump jack is constant regardless of the speed of the pump jack, when the number of rotations of the motor is reduced after the detection of the pump-off and the pump jack is thereby operated at a low speed, the motor is easy to be abnormal due to the overload especially when the motor structure is a totally-enclosed fan-cooled type; and, since the forcible re-start of the pump jack in the intermittent operation thereof is allowed only after the passage of a given time, the motor can be abnormal due to the short waiting time and the pump jack cannot be thereby operated, or, oppositely, the wait time can be longer than necessary and the crude oil is caused to coagulate, which makes it impossible for the pump jack to start again.

The present invention aims at solving the above problems found in the prior art technology. Thus, it is an object of the invention to provide a pump jack pump-off control method and a pump jack control apparatus in which, even when the speed of the pump jack is reduced due to the generation of the pump-off condition, the pump jack cannot be stopped due to the overload abnormality of the motor and the coagulation of the crude oil, but it can produce oil continuously in the oil well, and, in the pump-off time as well, the lowered production performance of the pump jack can be prevented as much as possible.

Means for Solving the Problems

According to the invention, the above-mentioned problems can be solved in the following manner.

That is, according to the invention as set forth in claim 1, there is provided a pump jack pump-off control method in which a pump jack is driven by an inverter having a power supply of a variable voltage and a variable frequency using an ac electric motor, the ac electric motor is protected against overload, and a pump-off condition of the pump jack is detected according to an average value or effective value of a secondary current of the ac electric motor during a down stroke period in each cycle of the pump jack or according to a delay time from each down stroke reference point to the maximum value of the secondary current of the ac electric motor, the method including the steps of:

on detecting the pump-off condition, reducing a speed of the pump jack by an amount equivalent to a previously set speed;

on detecting the pump-off condition in the reduced speed as well, reducing the pump jack speed sequentially step by step down to a previously set lowest speed; and during an operation of the pump jack with a speed thereof being reduced or during an operation of the pump jack at the lowest speed, switching the pump jack into an intermittent operation thereof according to an overload warning signal supplied from the ac electric motor.

According to the invention as set forth in claim 2, there is provided the pump jack pump-off control method, wherein in the intermittent operation, removal of the overload warning signal of the ac electric motor is a condition of start of re-operation of the pump jack.

Further, according to the invention as set forth in claim 3, there is provided the pump jack pump-off control method, wherein in the intermittent operation, a previous pump-off condition of the pump jack is used as a condition of start of re-operation of the pump jack.

Here, according to the findings and examination of the inventors, the cause of the above-mentioned problem found in the conventional technology is that gas is mixed into a cylinder, such mixed gas extends the time necessary for the closing of a suction valve (=the opening of a discharge valve) while a piston is moving from the up stroke end to the down stroke end, and thus, at the moment of the closing of the suction valve, the kinetic energy of the pump jack is applied to the valve and the inner wall of the cylinder. In other words, when the piston is pulled out quickly, the highly viscous crude oil is not able to follow the quick movement of the piston, which makes it easy to cause the mixing of the gas as well as a cavitation phenomenon or a liquid column separation phenomenon. Further, in order to prevent them, the highest speed of the piston pull-out in the suction step may not be limited to a sinusoidal wave form conventionally in use, but it may be effectively set in a rectangular wave form to thereby reduce the highest speed.

By the above findings and examination of the inventors, according to the invention as set forth in claim 4, there is provided a pump jack pump-off control method in which a pump jack is driven by an inverter having a power supply of a variable voltage and a variable frequency using an ac electric motor, and a pump-off condition of the pump jack is detected according to an average value or effective value of a secondary current of the ac electric motor during a down stroke period in each cycle of the pump jack or according to a delay time from each down stroke reference point to the maximum value of the secondary current of the ac electric motor, the method including the steps of:

on detecting the pump-off condition, switching the stroke speed in an up stroke operation of the pump jack from a sinusoidal wave form over to a rectangular wave form or driving the pump jack to execute an up stroke operation thereof during the operation thereof by the inverter with imposing a limit on torque.

According to the invention as set forth in claim 5, there is provided the pump jack pump-off control method, wherein on detecting the pump-off condition, the pump jack is operated in such a manner that a down stroke average speed of the pump jack is larger than an up stroke average speed thereof.

Further, in solving the above problem, the invention is structured in the following manner.

That is, according to the invention as set forth in claim 6, there is provided a pump jack control apparatus, including:

an inverter having a power supply of a variable voltage and a variable frequency;

a speed control portion for controlling a speed of an ac electric motor;

a pump-off control portion which, according to an average value or effective value of a secondary current of the ac electric motor during a down stroke period in each cycle of the pump jack or according to a delay time from each down stroke reference point to the maximum value of the secondary current of the ac electric motor, detects a pump-off condition of the pump jack, on detecting the pump-off condition, reduces a speed of the pump jack by a previously set speed, and on detecting the pump-off condition in the reduced speed as well, reduces the pump jack speed sequentially step by step down to a previously set lowest speed;

a speed control portion having an overload protection portion which, based on size of a current flowing in the ac electric motor, outputs an overload warning signal according to a calculation value obtained using at least adding calculation or according to a detect value of a temperature sensor mounted on the ac electric motor; and a pump jack control portion which, during an operation of the pump jack while the pump jack speed is being reduced or during an operation of the pump jack at the lowest speed, switches the pump jack into an intermittent operation thereof according to the overload warning signal of the ac electric motor.

Further, according to the invention as set forth in claim 7, there is provided the pump jack control apparatus as set forth in claim 6, wherein the pump-off control portion, on detecting the pump-off condition, outputs a speed instruction to the speed control portion in such a manner that a stroke speed of the pump jack in an up stroke operation thereof is switched from a sinusoidal wave form over to a rectangular wave form.

Further, according to the invention as set forth in claim 8, there is provided the pump jack control apparatus, wherein the pump-off control portion, on detecting the pump-off condition, outputs a speed instruction to the speed control portion in such a manner that a down stroke average speed of the pump jack is larger than an up stroke average speed thereof.

Effects of the Invention

According to the invention as set forth in claims 1 and 6, after detection of the pump-off condition, without causing the motor to be abnormal due to the overload, the pump jack can be operated continuously and also the crude oil can be prevented against coagulation. According to the invention as set forth in claims 2 and 3, the wait time in the intermittent operation of the pump jack can be optimized. According to the invention as set forth in claims 4 and 7, the pump jack can be operated with the maximum capacities of an ac electric motor and an inverter which are used. Further, according to the invention as set forth in claims 5 and 8, the reduction of the cycle time of the pump jack can be restored on the discharge side of the piston.

Moreover, when the above-mentioned pump-off control software is incorporated into a vector control inverter which is used to control the speed of the pump jack, it is possible to provide a pump jack control apparatus which, without using an expensive dynagraph card system composed of a rod load sensor and a microcomputer, is inexpensive and can prevent the reduction of the production capacity of the pump jack as much as possible.

DESCRIPTION OF REFERENCE NUMERALS AND SIGNS

Figure 1:
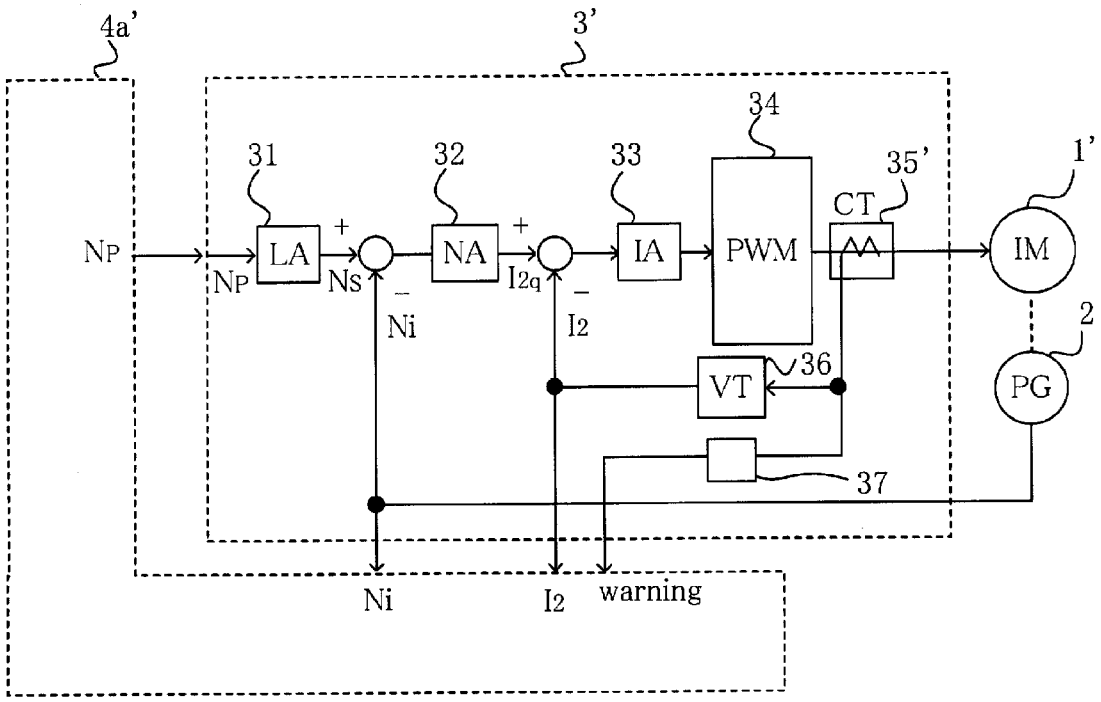
FIG. 1 is a block diagram of the structure of a pump jack control apparatus according to a first embodiment of the invention.
Figure 1:
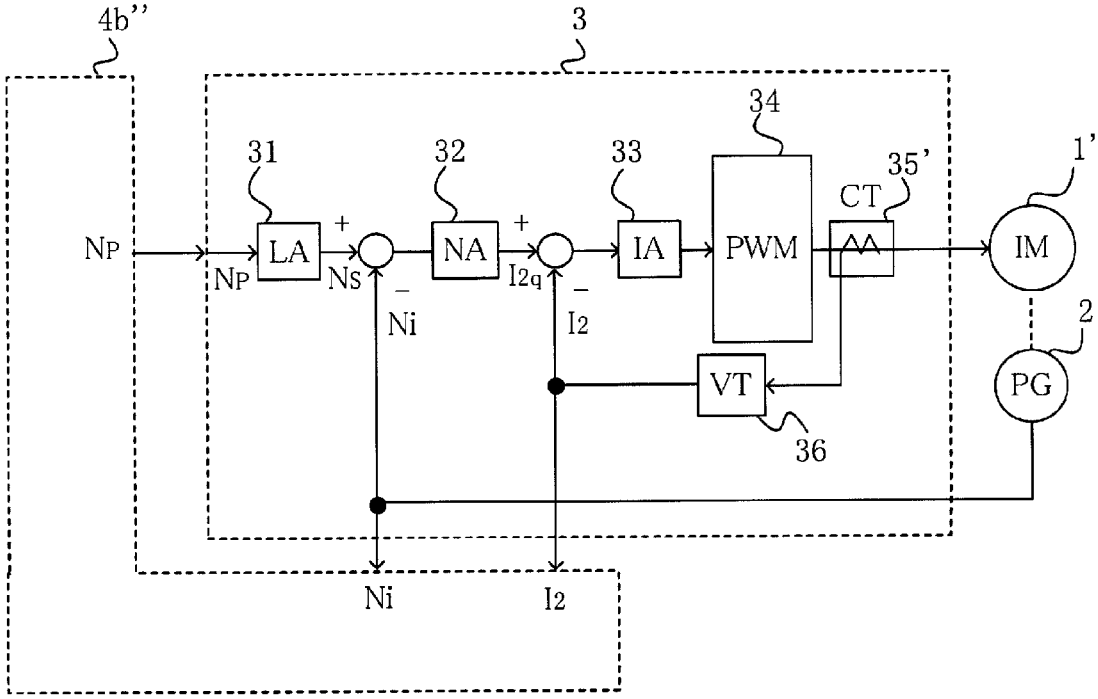

1: Induction motor
1': AC motor
2: Speed detector
3, 3': Vector control inverter
4, 4*a*, 4*b*, 4*a*', 4*b*', 4*b*": Pump-off control apparatus
20: Stroke position sensor
31: Straight line instructing device
32: Speed regulator
33: Current regulator
34: PWM controller
35: Current transformer
35': Current detector
36: Vector calculator
37: Overload detector
41: Calculator
42: Secondary current reference generator
43: Comparator
44: Output relay
45*a*, 45*b*, 45*a*', 45*b*', 45*b*": Sequencer
46, 46': Speed instruction function generator
47: Main speed setting device
48: Speed instruction switching device
49: Speed instructing device
51: IPCAL block
52: Memory element
60: Constant timing pulse generator
61: SIGMA block
62, 63: AND logical element
64, 65: Memory element
66: Reference cycle time calculator (CTCAL)
69: AND logical element
71: Pump-off detect relay
73: Stroke position switching device
74: Reference point signal generator (RPOSG)

BEST MODE FOR CARRYING OUT THE INVENTION

Now, description will be given below of specific embodiments according to the invention with reference to the accompanying drawings.

Embodiment 1

Figure 6:
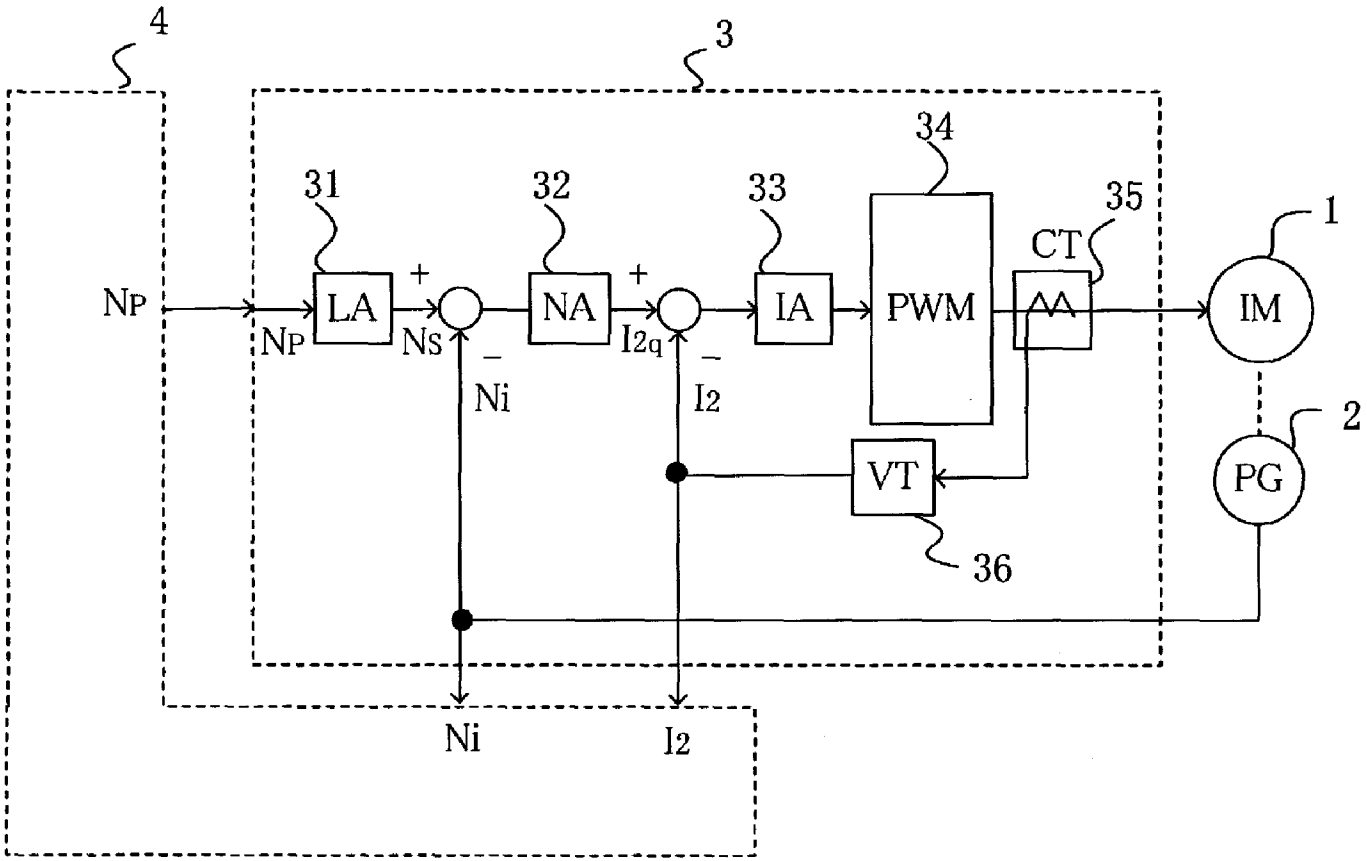
FIG. 6 PRIOR ART
FIG. 6 is a block diagram of the structure of a conventional pump jack control apparatus.

FIG. 1(*a*) is a block diagram of the structure of a pump jack control apparatus according to a first embodiment of the invention. In FIG. 1(*a*), according to the present embodiment, an overload detector 37 is added to the conventional structure shown in FIG. 6 and, in correspondence to this, there is employed a vector control inverter 3'; and, the functions of the pump-off control apparatus 4 are increased in part, thereby providing a pump-off control apparatus 4*a*'. The same parts as those of the conventional structure shown in FIG. 6 are given the same designations and thus the duplicate description of such parts and the operations thereof is omitted. Here, instead of the induction motor 1, there is used an ac motor 1'; and, instead of the current transformer 35, there is used a current detector 35' while they are the same in structure.

Next, description will be given below of the operation of the present pump jack control apparatus.

As a method for detecting an overload abnormality, there is known a method in which a given value 1 (for example, 110% of a motor rated current) is subtracted from a motor current detected by the current detector 35', the differences are added up and, when the added differences reach a given value 2, the motor is considered to be abnormal due to an overload.

The overload detector 37 outputs a warning signal before the added differences reach the given value 2 in the above-mentioned method, for example, when they reach 90% of the given value 2. Here, in this calculation, the differences are added up with a coefficient according to the function of the motor speed, thereby providing a heat model which corresponds to the characteristics of a motor which is driving the pump jack.

Figure 2:
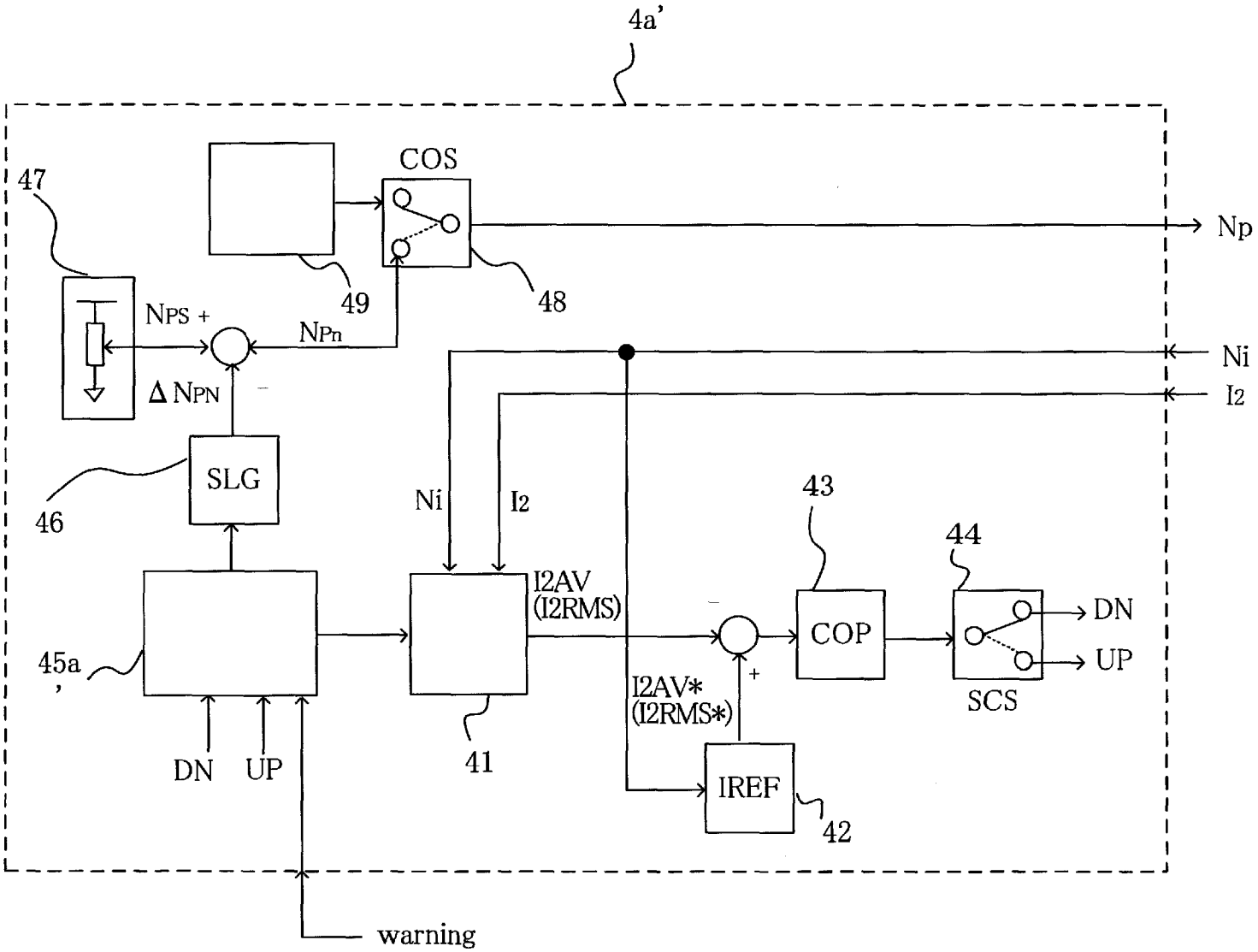
FIG. 2 is a block diagram of a first pump-off control according to a first embodiment of the invention.

A view to show the pump-off control of the pump-off control apparatus 4*a*' is structured like FIG. 2, for example. In FIG. 2, the function of the conventional sequencer 45*a* shown in FIG. 7 relating to the general control of the pump-off sequence is partially changed in the operation thereof, thereby providing a sequencer 45*a*'. The same parts as those shown in FIG. 7 are given the same designations and thus the duplicate description thereof is omitted here.

According to the general control of the pump-off sequence in the sequencer 45*a*', when an overload warning signal from the overload detector 37 is input to the pump-off control apparatus 4*a*', the operation of the pump jack is caused to stop; and, when the overload warning signal is removed, the pump jack is resumed at the speed instructed by the speed instructing device 49, that is, at the lowest speed.

In this manner, according to the overload warning signal from the overload detector 37, the stop of the operation of the pump jack and the re-start thereof at the lowest speed can be carried out. Therefore, during the operation of the pump jack while the speed thereof is reducing, or during the operation thereof at the lowest speed, the overload protection of the ac motor 1' is executed, whereby the pump jack cannot be made impossible to operate but can be operated intermittently.

Figure 3:
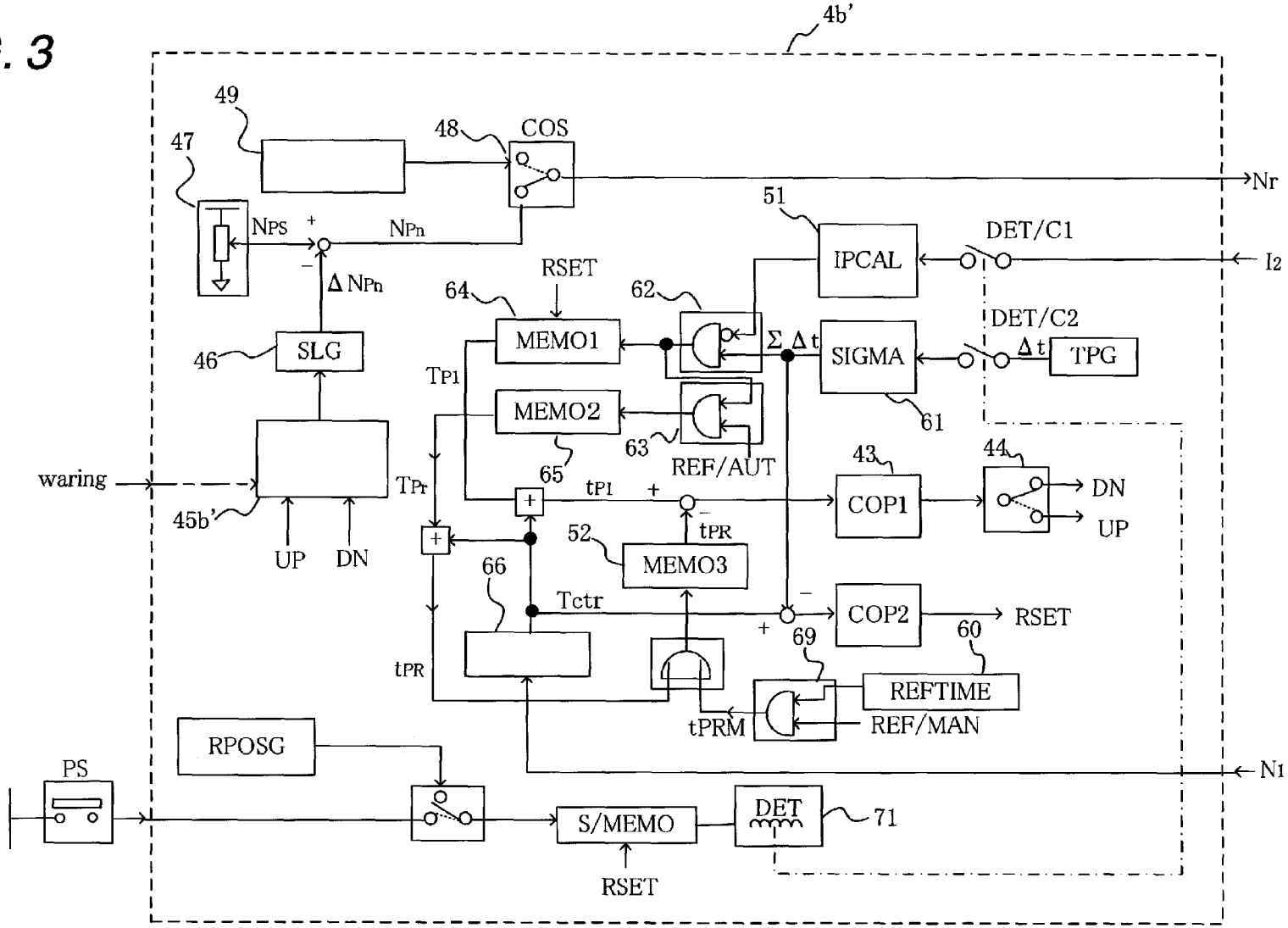
FIG. 3 is a block diagram of a second pump-off control according to the first embodiment of the invention.
Figure 7:
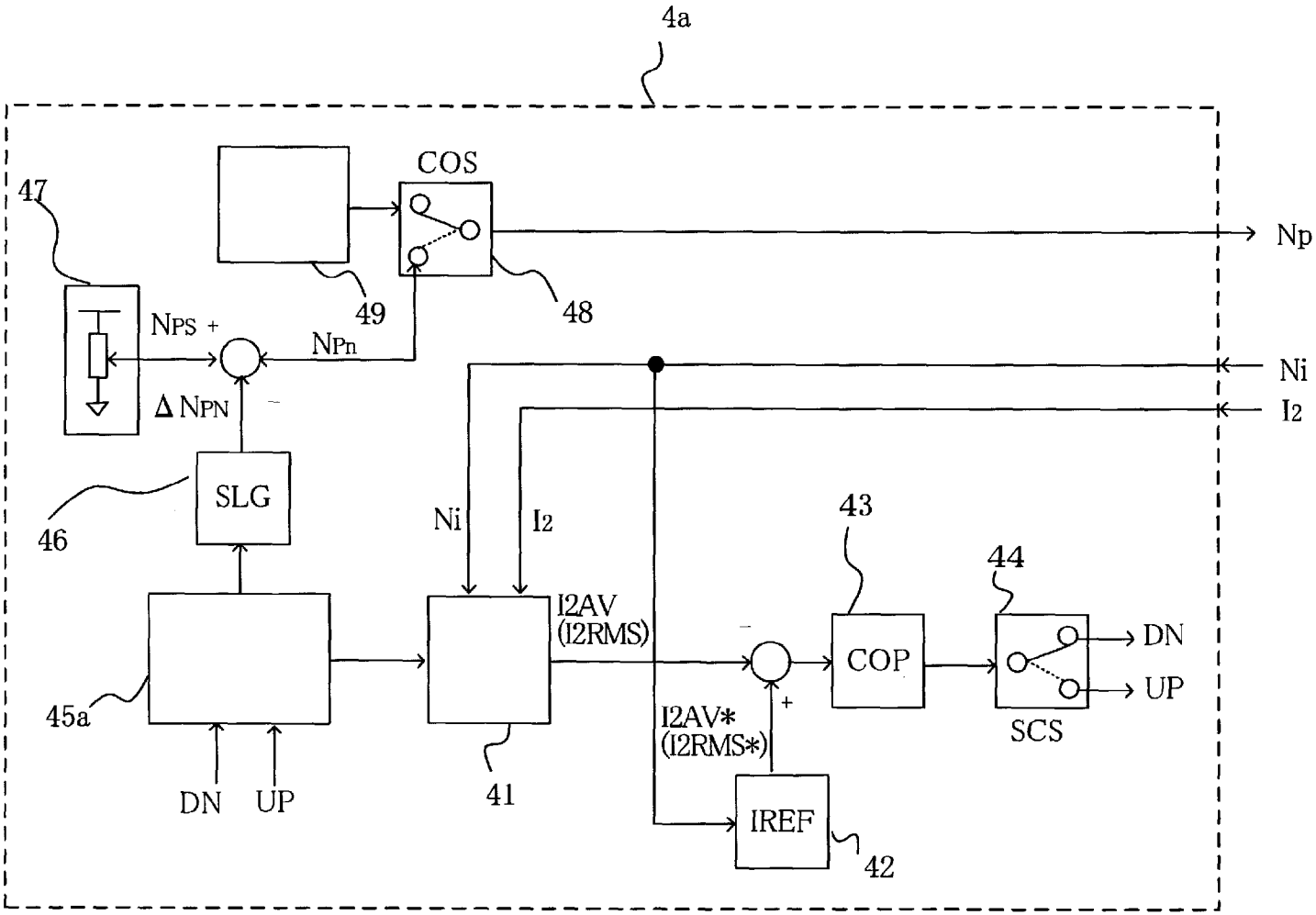
FIG. 7 PRIOR ART
FIG. 7 is a block diagram of a first pump-off control used in the conventional pump jack control apparatus.
Figure 8:
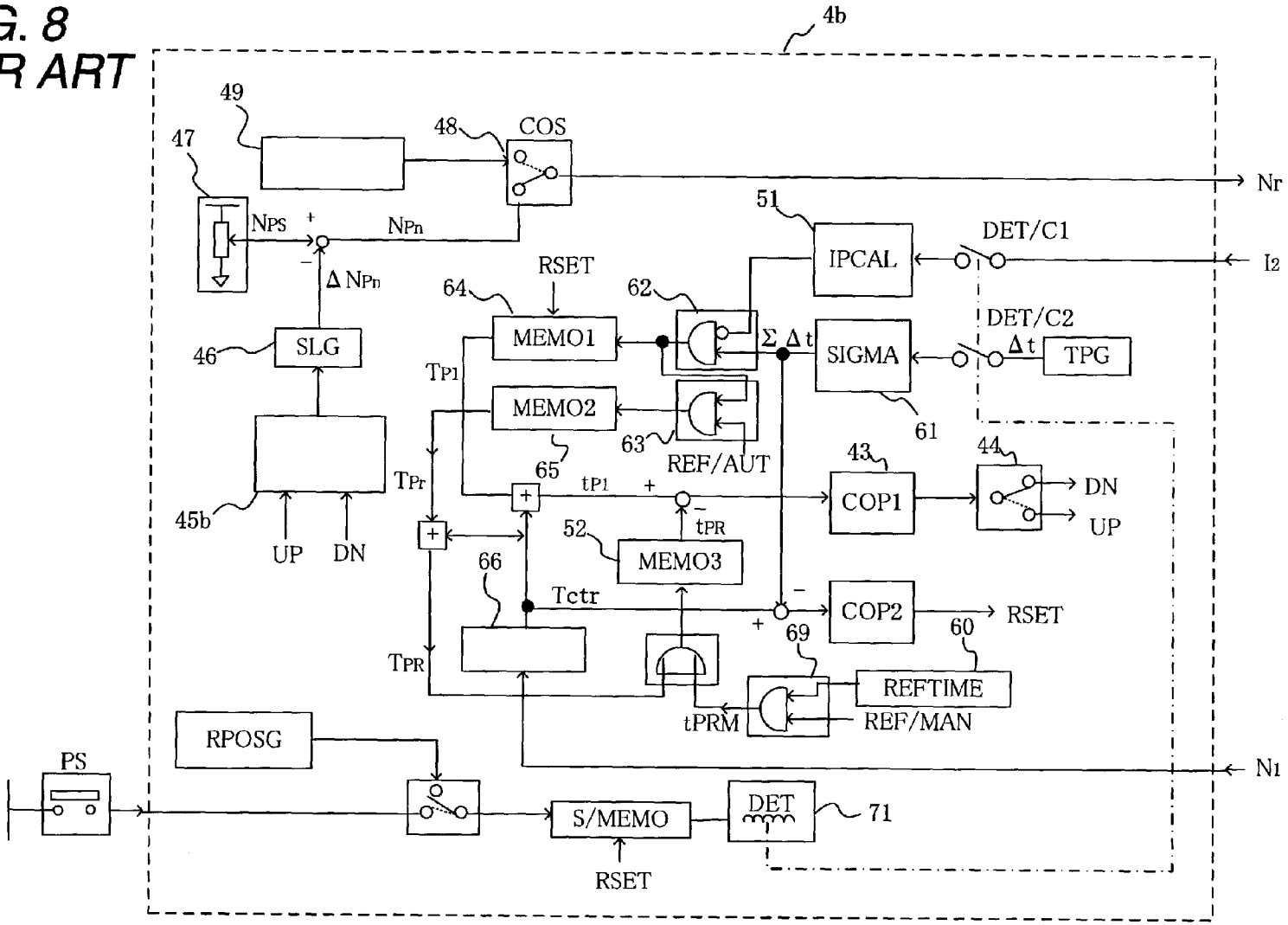
FIG. 8 PRIOR ART
FIG. 8 is a block diagram of a second pump-off control used in the conventional pump jack control apparatus.

Also, a block diagram of the pump-off control of the pump-off control apparatus 4*a*' is structured like FIG. 2 which corresponds to FIG. 7 showing the prior art; however, also when the block diagram is structured like FIG. 3 which corresponds to FIG. 8 showing the prior art, the present pump-off control apparatus can be realized similarly.

The structure shown in FIG. 3 is different from the conventional structure shown in FIG. 8, similarly to FIGS. 2 and 7, only in that the operation of the function relating to the general control of the pump-off sequence by the sequencer 45*a*' is changed in part to thereby provide a sequencer 45*b*'. Therefore, the description of the structure shown in FIG. 3 is omitted here.

Here, the overload detector 37 may also be replaced with a structure in which a temperature sensor (not shown) is incorporated in the ac motor 1' and, before the temperature of the sensor reaches a given value of an overload abnormal value, for example, about 10° C. before it reaches the given value, a warning signal is output.

Owing to this structure, according to the present embodiment, the timing of the re-start of the intermittent operation can be determined according to the overload warning signal.

In the foregoing description, the interval time in the intermittent operation can be decided according to the warning signal from the overload detector 37. However, alternatively, the interval time in the intermittent operation may also be determined according to the pump-off condition in the previous pump jack suction time; or, with the pump-off condition in the previous pump jack suction time taken into consideration, the interval time in the intermittent operation may also be decided rather long in such a manner that, as the time taken for the pump-off condition increases, that is, as I2AV becomes larger than I2AV* (or, I2RMS is larger than I2RMS*), or, TP1 becomes larger than TPR, there can be secured more time to wait for the removal of the pump-off condition.

Embodiment 2

FIG. 1(*b*) is a block diagram of the structure of a pump jack control apparatus according to a second embodiment of the invention. A pump jack control apparatus shown in FIG. 1(*b*) has a certain new function added to the functions of the conventional pump-off control apparatus 4, thereby providing a pump-off control apparatus 4*b*". That is, the pump-off control apparatus 4*b*" is the same in the remaining portions thereof as the conventional pump-off control apparatus 4 and thus the description thereof is omitted here. Here, the induction motor 1 is replaced with an ac motor 1'; and, the transformer 35 is replaced with a current detector 35', although they are the same in structure.

Figure 4:
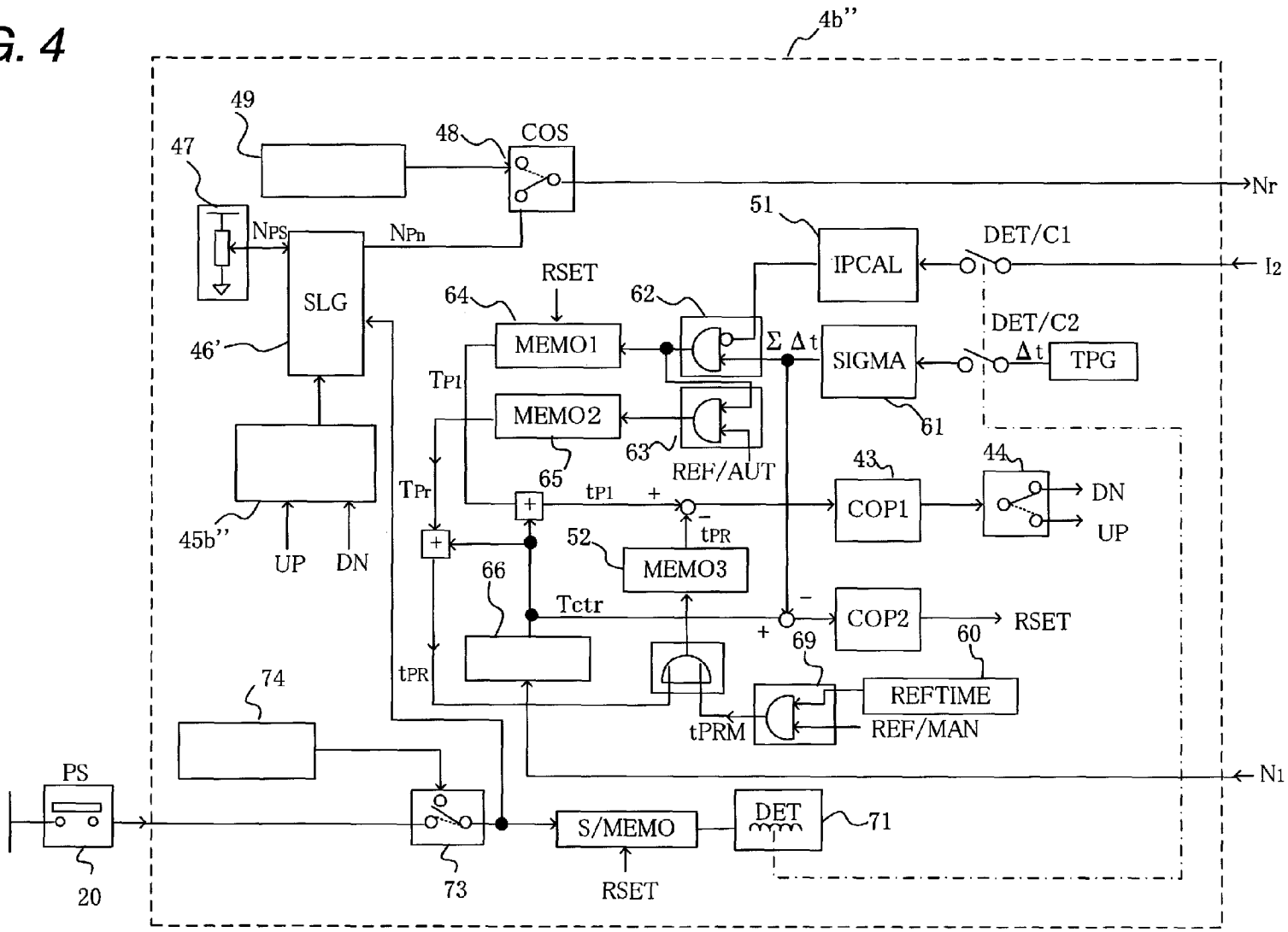
FIG. 4 is a block diagram of a pump-off control according to a second embodiment of the invention.

FIG. 4 is a block diagram of a pump-off control employed in a pump jack control apparatus according to a second embodiment of the invention. In FIG. 4, the conventional speed instruction function generator 46 shown in FIG. 8 is replaced with a speed instruction function generator 46' which can switch the pattern of the speed instruction from a sinusoidal wave form to a rectangular wave form. Either of the signal of a stroke position sensor 20 for detecting the stroke position of the pump jack output through a stroke position switching device 73 or the signal of a reference point signal generator 74 for processing software is input to the speed instruction function generator 46'. Also, a portion of the operation of the function of the sequencer 45*b* relating to the pump-off sequence general control is changed, thereby providing a sequencer 45*b*". The same composing parts of the pump jack control apparatus shown in FIG. 4 as those of the conventional pump jack control apparatus shown in FIG. 8 are given the same designations and thus the duplicate description thereof is omitted here.

Next, description will be given below of the operation of the second embodiment.

The sequencer 45*b*", on detecting the generation of the pump-off condition according to the output of the comparator 43, controls the speed instruction function generator 46' in such a manner that the stroke speed of the pump jack can be switched from a sinusoidal wave form operation to a rectangular wave form (constant speed) operation in the up stroke time.

The speed instruction function generator 46' calculates the speed setting Npn according to the highest speed Nps, namely, the output of the main speed setting device 47 corresponding to the then-time state of the oil well and the output of the sequencer 45", namely, the state of generation of the pump-off.

Firstly, according to a crank angle obtained by referring to the stroke position of the pump jack which is output through the stroke position switching device 73, it is checked whether the stroke operation is an up stroke operation or a down stroke operation.

Next, when the stroke operation is the up stroke operation, the speed setting Npn is calculated such that $\{0.637\times(Nps-\Delta Npn)/K-\Delta\}\times K/\sin(\theta+180°)$; and, for the down stroke operation, the speed setting Npn is calculated such that $2\times(Nps-\Delta Npn)+K\times\Delta/0.637$. When the average speed in the up and down strokes is low, the speed setting Npn is output in such a manner that such low average speed can be compensated.

Here, $2/\pi=0.637$ is a coefficient which is used to prevent the average speed against change when the stroke average speed is set for a sinusoidal wave form; ΔNpn expresses the speed that is reduced when the pump-off is detected; K is a conversion coefficient between the stroke speed and motor speed which is determined according to a mechanical constant (mechanical design specifications) depending on the link mechanism of the pump jack; and, Δ is a value which is used to adjust the rectangular wave form speed.

In this manner, there is provided the speed setting of the motor in which the stroke speed provides a rectangular wave form.

When the pump-off is removed and the speed is returned back to the initial speed, the speed instruction function generator 46' outputs the output value Nps of the main speed setting device 47 as the speed setting Npn.

And, while the upper limit of the speed setting Npn is limited by the motor specifications, the speed setting Npn is output through the speed instruction switching device 48 to the vector control apparatus 3 as the speed reference Np.

Figure 5:
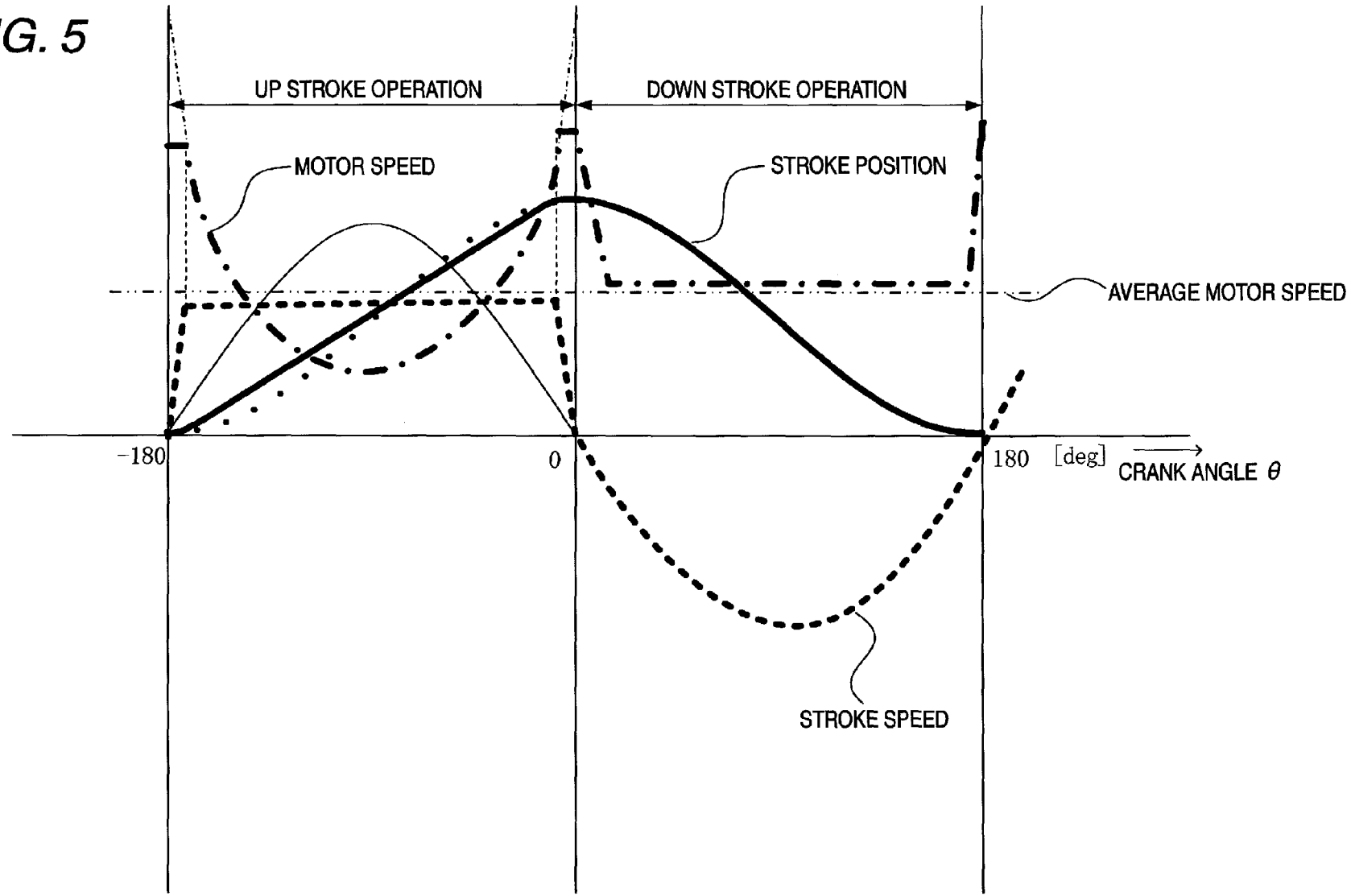
FIG. 5 is a graphical representation of an example of rectangular wave form speed setting used in the second embodiment.

FIG. 5 shows an example of the speed setting that is obtained in the above-mentioned manner. In FIG. 5, while a crank angle θ is expressed on the horizontal axis, there are shown the signals of the motor speeds, stroke speeds and stroke positions in the up stroke operation and in the down stroke operation.

The stroke speeds in the up stroke operation are limited to a given value which is smaller than the peak value of the sinusoidal wave form instruction values in the normal operation of the pump jack, and also vary substantially in a step-like manner in the vicinity of 0° and −180° of the crank angle θ. Therefore, the motor speed is limited by the highest speed of the motor specifications, and the pump jack is operated under the torque limited condition for protection of machines including an electric motor, an inverter, a down hole pump, a sucker rod and the like.

As a result of this, the actual stroke speed provides a trapezoidal wave form and the pump jack is operated with the maximum capacity of the drive system. In this manner, the highest speed in the discharge time can be reduced and, when the average discharge speed of the piston portion is lowered, by increasing the suction speed, the cycle time can be reduced.

Also, as a modification of the speed pattern, in the down stroke operation, similarly to the up stroke operation, the stroke speed may be set so as to provide a rectangular wave form.

Next, description will be given below of a method for detecting the crank angle θ.

To detect the crank angle, there may be mounted on the pump jack a stroke position sensor 20 of a mechanical, or magnetic, or optical type and the stroke position of the pump jack may be obtained by the stroke position sensor 20: that is, the crank angle θ can be found from the thus obtained stroke position.

Also, when it is difficult to mount the stroke position sensor 20 due to the mechanical structure limit or the like, the signals of the down stroke start and up stroke start may be obtained using the reference point signal generator 74 and, after then, the crank angle θ may be calculated and estimated from the stroke speed. Here, similarly to the down stroke start signal disclosed in the patent reference 1 cited above as the conventional technology, the up stroke start signal may be calculated and thus the description thereof is omitted here.

Owing to such structure, according to the present embodiment, when the pump-off condition is detected, the pump jack can be operated in such a manner that not only the highest speed of the up stroke (sucking operation) of the pump jack can be controlled but also the average speed thereof can be maintained constant.

Although the above embodiment has been described assuming that it includes the speed detector, the present embodiment may also be applied to a vector control apparatus not including such speed detector.

Also, owing to the recent progress of the electric motor control, in spite of the V/f constant control, it has been possible to put a limit on torque and also to calculate the secondary current of the ac motor according to another technique. The invention may also be applied using an electric motor control apparatus having such structure.

Further, it goes without saying that the invention can also be applied not only to an electric motor such as an induction motor or a synchronous motor but also to another ac electric motor.

INDUSTRIAL APPLICABILITY

The present invention can be applied to a pump jack control apparatus for controlling a beam pump to be driven by a pump jack, and a pump-off control method for controlling the pump off of the pump jack.

The invention claimed is:

1. A pump jack pump-off control method in which a pump jack is driven by an inverter having a power supply of a variable voltage and a variable frequency using an ac electric motor, the ac electric motor is protected against overload, and a pump-off condition of the pump jack is detected according to an average value or effective value of a secondary current of the ac electric motor during a down stroke period in each cycle of the pump jack or according to a delay time from each down stroke reference point to the maximum value of the secondary current of the ac electric motor, the method comprising the steps of:

on detecting the pump-off condition, reducing a speed of the pump jack by an amount equivalent to a previously set speed;

on detecting the pump-off condition in the reduced speed as well, reducing the pump jack speed sequentially step by step down to a previously set lowest speed; and during an operation of the pump jack with a speed thereof being reduced or during an operation of the pump jack at the lowest speed, switching the pump jack into an intermittent operation thereof according to an overload warning signal supplied from the ac electric motor.

2. The pump jack pump-off control method as set forth in claim 1, wherein in the intermittent operation, removal of the overload warning signal of the ac electric motor is a condition of start of re-operation of the pump jack.

3. The pump jack pump-off control method as set forth in claim 1, wherein in the intermittent operation, a previous pump-off condition of the pump jack is used as a condition of start of re-operation of the pump jack.

4. A pump jack control apparatus, comprising:

an inverter configured to supply a power of a variable voltage and a variable frequency to drive an ac electric motor; and a pump-off control portion which, according to an average value or effective value of a secondary current of the ac electric motor during a down stroke period in each cycle of the pump jack or according to a delay time from each down stroke reference point to the maximum value of the secondary current of the ac electric motor, detects a pump-off condition of the pump jack, on detecting the pump-off condition, reduces a speed of the pump jack by a previously set speed, and on detecting the pump-off condition in the reduced speed as well, reduces the pump jack speed sequentially step by step down to a previously set lowest speed, wherein the inverter includes an overload protection portion which, based on size of a current flowing in the ac electric motor, outputs an overload warning signal according to a calculation value obtained using at least adding calculation or according to a detect value of a temperature sensor mounted on the ac electric motor, and wherein the pump-off control portion includes a pump jack control portion which, during an operation of the pump jack while the pump jack speed is being reduced or during an operation of the pump jack at the lowest speed, switches the pump jack into an intermittent operation thereof according to the overload warning signal of the ac electric motor.

5. The pump jack control apparatus as set forth in claim 4, wherein the pump-off control portion, on detecting the pump-off condition, outputs a speed instruction to the inverter in such a manner that a stroke speed of the pump jack in an up stroke operation thereof is switched from a sinusoidal wave form over to a rectangular wave form.

6. The pump jack control apparatus as set forth in claim 5, wherein the pump-off control portion, on detecting the pump-off condition, outputs a speed instruction to the inverter in such a manner that a down stroke average speed of the pump jack is larger than an up stroke average speed thereof.

7. A pump jack pump-off control method as set forth in claim 1 further comprising:

on detecting the pump-off condition, switching the stroke speed in an up stroke operation of the pump jack from a sinusoidal wave form over to a rectangular wave form or driving the pump jack to execute an up stroke operation thereof during the operation thereof by the inverter with imposing a limit on torque.

8. The pump jack pump-off control method as set forth in claim 7, wherein on detecting the pump-off condition, the pump jack is operated in such a manner that a down stroke average speed of the pump jack is larger than an up stroke average speed thereof.

* * * * *